US012103740B2

(12) United States Patent
Harris et al.

(10) Patent No.: US 12,103,740 B2
(45) Date of Patent: Oct. 1, 2024

(54) DRINKING VESSEL WITH HYGIENIC STRAW

(71) Applicant: Base Brands, LLC, Atlanta, GA (US)

(72) Inventors: Jamison Corey Harris, Brookhaven, GA (US); Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 635 days.

(21) Appl. No.: 17/118,350

(22) Filed: Dec. 10, 2020

(65) Prior Publication Data

US 2022/0106084 A1 Apr. 7, 2022

Related U.S. Application Data

(63) Continuation-in-part of application No. 29/754,112, filed on Oct. 6, 2020, now Pat. No. Des. 954,493.

(51) Int. Cl.

| | |
|---|---|
| ***B65D 47/06*** | (2006.01) |
| ***A47G 21/18*** | (2006.01) |
| ***B65D 47/08*** | (2006.01) |

(52) U.S. Cl.

CPC ..... *B65D 47/066* (2013.01); *A47G 21/186* (2013.01); *B65D 47/089* (2013.01)

(58) Field of Classification Search

CPC ... B65D 47/089; B65D 47/066; A47G 21/186
See application file for complete search history.

(56) References Cited

U.S. PATENT DOCUMENTS

| | | | | |
|---|---|---|---|---|
| 8,376,173 | B2 | 2/2013 | Britto et al. | |
| D922,135 | S * | 6/2021 | Chen | D7/392.1 |
| 2012/0312832 | A1* | 12/2012 | Lane | B65D 47/0885 220/774 |
| 2015/0282654 | A1* | 10/2015 | Kurabe | A47G 19/2272 220/254.5 |

FOREIGN PATENT DOCUMENTS

| | | |
|---|---|---|
| CN | 205525647 U | 8/2016 |

OTHER PUBLICATIONS

Zak Designs, "Zak Designs 16oz Riverside Beach Life Kids Water Bottle with Straw and Build in Carrying Loop", Amazon.com, retrieved from https://www.amazon.com/Zak-Designs-6827-T351 on Feb. 14, 2024.

* cited by examiner

*Primary Examiner* — Jeffrey R Allen
(74) *Attorney, Agent, or Firm* — Park, Vaughan, Fleming & Dowler LLP

(57) ABSTRACT

Described herein are embodiments of systems and apparatuses that include a drinking vessel with a hygienic straw. In an embodiment, the apparatus includes a container and a lid, where the lid is configured to engage an opening of a container to retain the liquid within the container. The lid may further include a drinking straw for use in extracting liquid from the container. The straw may be attached to the lid so that it can be covered, uncovered, and/or otherwise accessed without the need to physically touch the straw itself.

23 Claims, 13 Drawing Sheets

DRINKING VESSEL WITH HYGIENIC STRAW

RELATED APPLICATION

This design patent application is a continuation-in-part of pending U.S. Design patent application No. 29/754,112, entitled "Container For Liquids," by inventors Jamison Corey Harris, Patrick Spivey and Kenneth Kreafle, which was filed on 6 Oct. 2020, the contents of which are herein incorporated by reference in their entirety for all purposes.

FIELD OF THE INVENTION

This disclosure generally relates to drinking vessels and, more specifically, to a drinking vessel with a hygienic straw.

BACKGROUND

Drinking vessels, such as cups, insulated beverage containers, canteens, and the like are used to contain fluids for drinking. Fluids tend to spill if left in an open container, so many drinking vessels include a lid. Some lids include openings for allowing controlled passage of the fluid to a user of the vessel. In some cases, the opening is a hole or slot for receiving a drinking straw. In some such cases the drinking straw is removable, and in other cases the drinking straw is permanently affixed to the container's lid. In either case, it is known that the handling of such straws—when inserting them, removing them, adjusting them, or otherwise—can contaminate the straw. Preventing and/or at least limiting such contamination has become more important than ever in modern society, especially in light of the recent emphasis on and spread of harmful viruses, germs, and other contaminants.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Described herein are embodiments of systems and apparatuses that include a drinking vessel with a hygienic straw. In an embodiment, an apparatus includes a container and a lid, where the lid is configured to engage an opening of a container to retain the liquid within the container. The lid may further include a drinking straw for use in extracting liquid from the container. The straw may be attached to the lid so that it can be covered, uncovered, and/or otherwise accessed without the need to physically touch the straw itself. As such, the container and lid provide a hygienic combination not previously known.

BRIEF DESCRIPTION OF THE DRAWINGS

The disclosure may be understood by reference to the following description taken in conjunction with the accompanying drawings, in which like reference numerals identify like elements, and in which.

Figure 1:
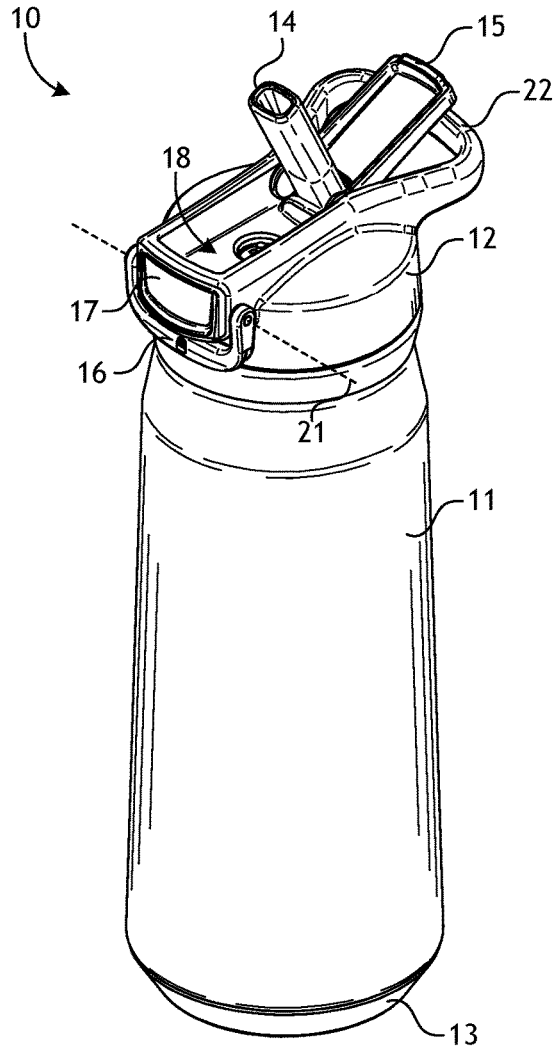
FIG. 1 is a front side perspective view of one embodiment of a drinking vessel with a hygienic straw in its open configuration.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined by the appended claims.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meeting, i.e., a meaning other than that understood by skilled artisans, such a special definition will be expressly set forth in the specification in a definitional manner that directly and unequivocally provides the special definition for the term or phrase.

The present embodiments describe a drinking vessel with a hygienic straw. FIG. 1 is a front side perspective view of one embodiment 10 of a drinking vessel with a hygienic straw in its open configuration. The vessel combination 10 includes container 11 and lid 12. Lid 12 preferably is attached to container 11 via a threaded connection (see FIGS. 17 and 36-37), but also can be attached in other ways known to those skilled in the art, such as snap-on or other substantially leak-proof manners. Container 11 can be made from any suitable material, including vacuum-sealed layers to preserve the temperature of the container's contents. Bumper guard 13 can be formed from a material different from that of container 11. In one embodiment it is affixed to or otherwise integrated onto the bottom of container 11 in order to provide a skid-proof surface, a scratch-proof surface, and/or one that inhibits condensation, thereby protecting the surface on which vessel combination 10 is placed.

Figure 9:
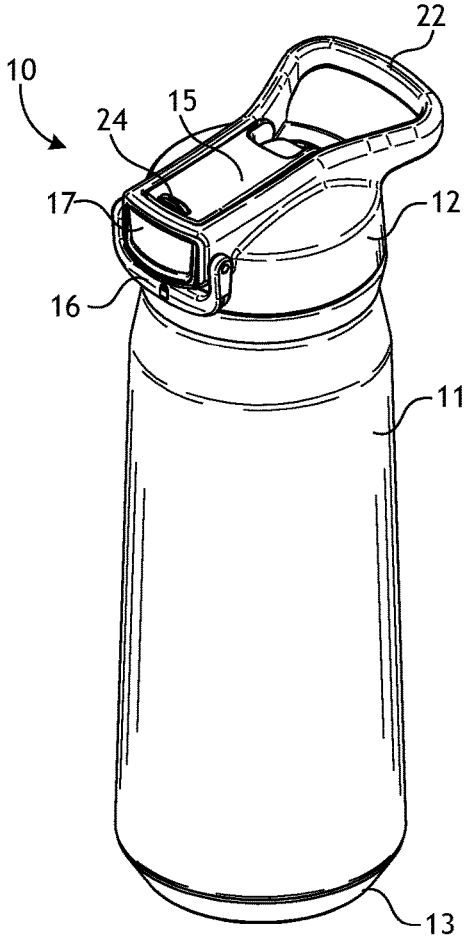
FIG. 9 is a front side perspective view of one embodiment of a drinking vessel with a hygienic straw in its closed, unlocked configuration.
Figure 39:
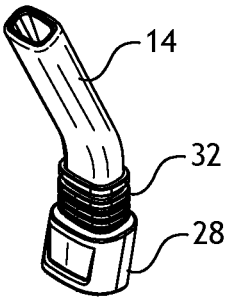
FIG. 39 is a front perspective view of one embodiment of an upper portion of a straw for a drinking vessel.
Figure 40:
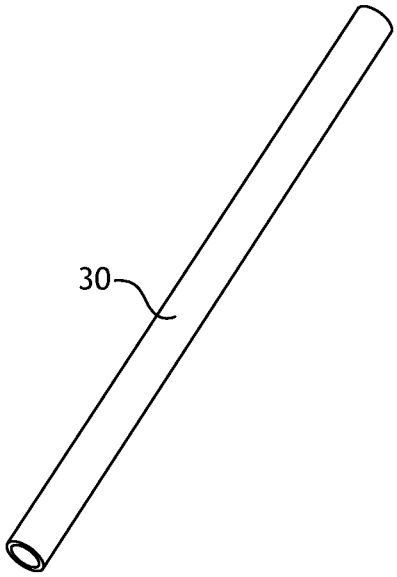
FIG. 40 is a front perspective view of one embodiment of a lower portion of a straw for a drinking vessel.

Lid 12 includes straw 14 protruding there-through. As will be described below in more detail in connection with FIGS. 38-40, straw 14 includes a flexible upper portion (shown protruding through lid 12) that can be used to withdraw liquid housed by container 11. Lid 12 further includes straw receptacle area 18, which preferably is sized to receive/house the illustrated portion of straw 14. This occurs when straw cover 15 is forced (by hand generally from right to left in FIG. 1) to pivot along a hinged axis from its "open" position (as shown in FIG. 1) to its "closed" position (as shown in FIG. 9). More specifically, as straw cover 15 is closed by hand, it contacts straw 14 and—due to the flexibility of straw 14—causes straw 14 to bend/fold down into and lay flush in straw receptacle area 18. As will be described in more detail below, straw cover 15 is held in its "closed" position by latch 17, which can be further locked into place by lock 16 (as described in more detail below). Still further, in a preferred embodiment, straw cover 15 freely rotates about its hinged axis, but in another embodiment it can be biased by a spring-loaded hinge so as to maintain straw cover 15 in its open position when at rest with no other forces acting upon it.

Figure 2:
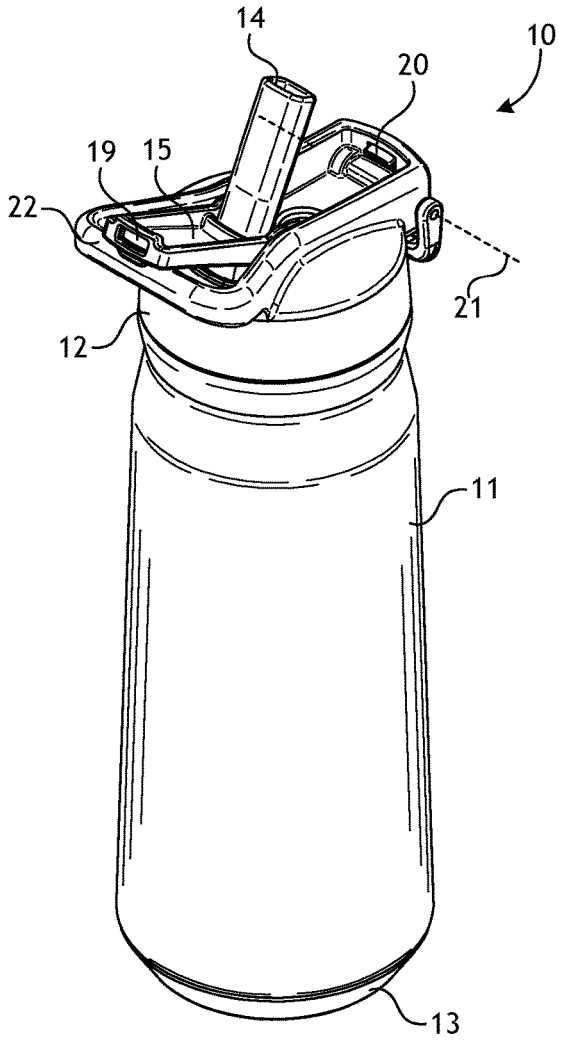
FIG. 2 is a backside perspective view of one embodiment of a drinking vessel with a hygienic straw in its open configuration.

FIG. 2 is a backside perspective view of one embodiment 10 of a drinking vessel with a hygienic straw in its open configuration. FIG. 2 better illustrates the manner in which straw cover 15 interacts with straw 14. Specifically, as explained above, as straw cover 15 is closed by hand, it contacts straw 14 and—due to the flexibility of straw 14—causes straw 14 to bend/fold down into and lay flush in straw receptacle area 18. Once straw cover 15 is substantially "closed" (as shown in FIG. 9), tab receptacle 19 on one end of straw cover 15 receives tab 20 disposed on latch 17, thereby maintaining straw cover 15 its "closed" position. Latch 17 is mounted to lid 12 via a spring loaded hinged axis so that when straw cover 15 contacts tab 20 during its "closing" operation, cover 15 causes latch 17 (including tab 20) to recess (against the force of its spring loading) until straw cover 15 closes sufficiently to allow tab 20 to spring back to its original position (due to the force of its spring loading), which is now within tab receptacle 19. Although straw 14 is flexible, it also has an elastomeric nature that causes it to retake the position shown in FIGS. 1 and 2 when it is at rest with no countermanding forces acting upon it. As such, closing straw cover 15 by rotating it (by hand) about its hinged axis requires a small amount of force, and the interaction of the spring loaded combination of latch 17 (including tab 20) and tab receptacle 19 are necessary to keep straw cover 15 in its closed position.

As mentioned and as also shown in connection with both FIGS. 1 and 2, tab 20 is part of latch 17. Latch 17 is mounted to lid 12 via spring-loaded hinged axis 21 such that pressing (by hand) on the lower portion of latch 17 causes the latch to pivot about axis 21. The spring-loaded nature of hinged axis 21 and its association with latch 17 causes tab 20 to move out of tab receptacle 19 when the lower portion of the latch is activated/pressed. When that happens, straw cover 15 is "unlatched" and at least the elastomeric nature of straw 14 causes straw cover 15 to withdraw to its "open" position and straw 14 to assume is open and ready-to-use position as shown in FIGS. 1 and 2. Accordingly, drinking vessel 10 can be "opened" (and made ready for use by a user) or "closed" (for non-use or storage) without the user ever coming into contact with straw 14. The health, safety, sanitary, and overall efficacy of such design is apparent, especially with the heightened sensitivity to viruses, germs, and overall health safety measures currently so prevalent in modern society.

FIGS. 1-2 also depict lid handle 22. Lid handle 22 is not limited to the shape depicted in FIGS. 1-2 and can be any shape suitable for carrying combination 10 and/or tethering the combination to a user or other object. In one embodiment, lid handle 22 is made of at least one material located in the region where straw cover 15 contacts the lid handle and another material for the other regions of the lid handle. The material in the region where straw cover 15 contacts the lid handle preferably is a material that dampens the sound made when straw cover 15 strikes lid handle 22 during the lid opening process. (Note that when straw cover 15 is unlatched from its closed position, the elastomeric nature of straw 14 causes straw cover 15 to spring open by pivoting about its axis with enough force to strike lid handle 22.) For example, such sound-dampening material could be a thermoplastic elastomer, whereas the remaining portion of the lid handle could be polypropylene.

Figure 3:
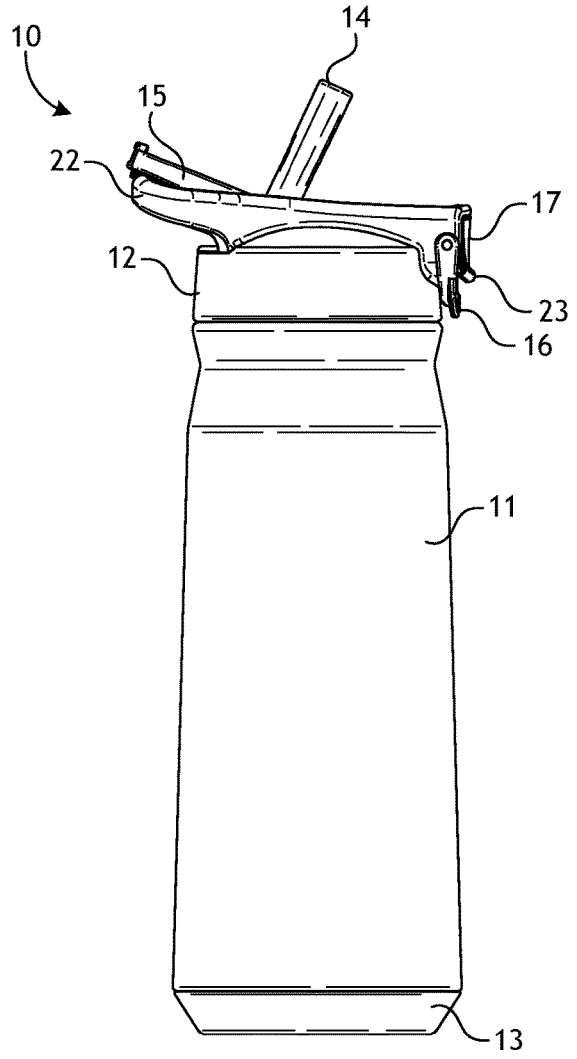
FIG. 3 is a left side view of one embodiment of a drinking vessel with a hygienic straw in its open configuration.
Figure 4:
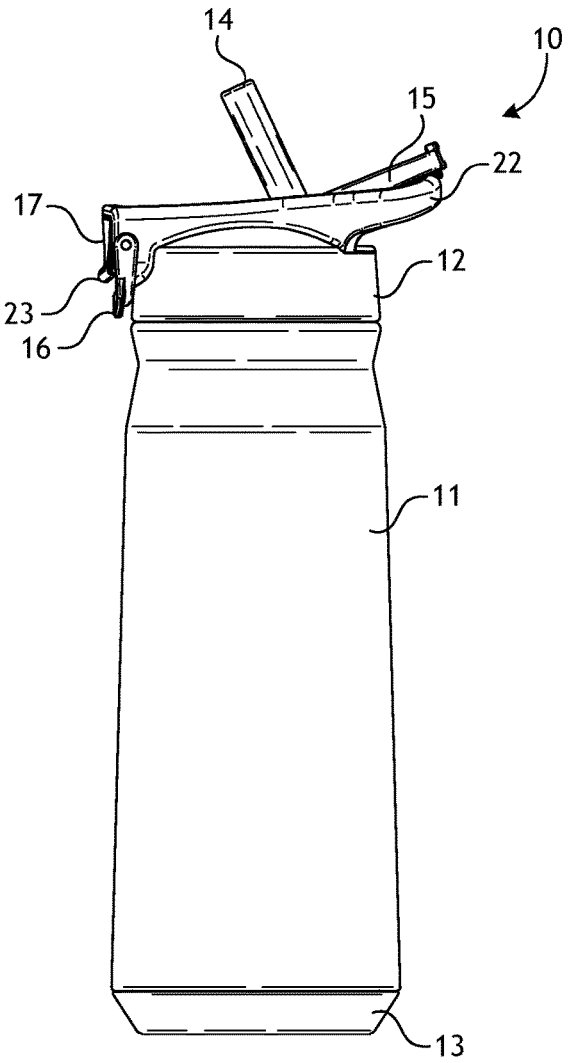
FIG. 4 is a right side view of one embodiment of a drinking vessel with a hygienic straw in its open configuration.

FIG. 3 is a left side view of one embodiment 10 of a drinking vessel with a hygienic straw in its open configuration. FIG. 4 is a right side view of one embodiment 10 of a drinking vessel with a hygienic straw in its open configuration. While both FIGS. 3 and 4 (as well as FIGS. 1 and 2) show the "open" configuration as having straw cover 15 fully retracted and resting on lid handle 22, such position is not required. It is sufficient that the "open" configuration be only such that straw 14 is available for use by a user to extract liquid (through the straw) from container 11.

FIGS. 3 and 4 likewise further illustrate the shape and functionality of latch 17. As shown in both Figures, latch 17 (in this particular embodiment) is flat with a slight outwardly protruding lip 23 at its lower end. This slight lip 23 allows a user to easily run his or her finger down the face of the latch so as to activate the latch (against its spring loaded capacity) without actually having to depress the latch. In other words, the lip 23 on latch 17 allows it to be activated without physically pushing the latch in toward lid 12. Of course, as described above, when latch 17 is activated in such manner, tab 20 moves out of tab receptacle 19 and the elastomeric nature of straw 14 causes it and straw cover 15 to spring or snap to their open positions without a user ever having touched the straw.

Figure 5:
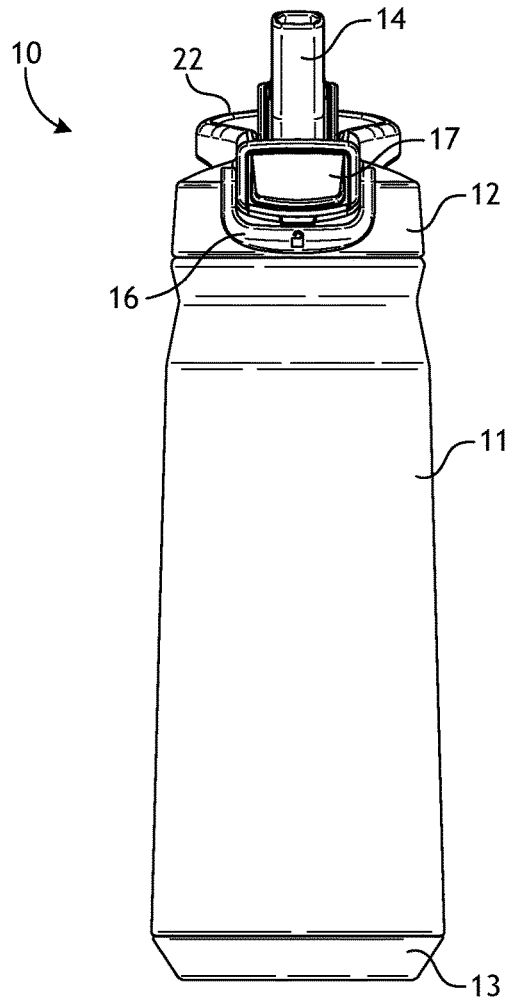
FIG. 5 is a front side view of one embodiment of a drinking vessel with a hygienic straw in its open configuration.
Figure 6:
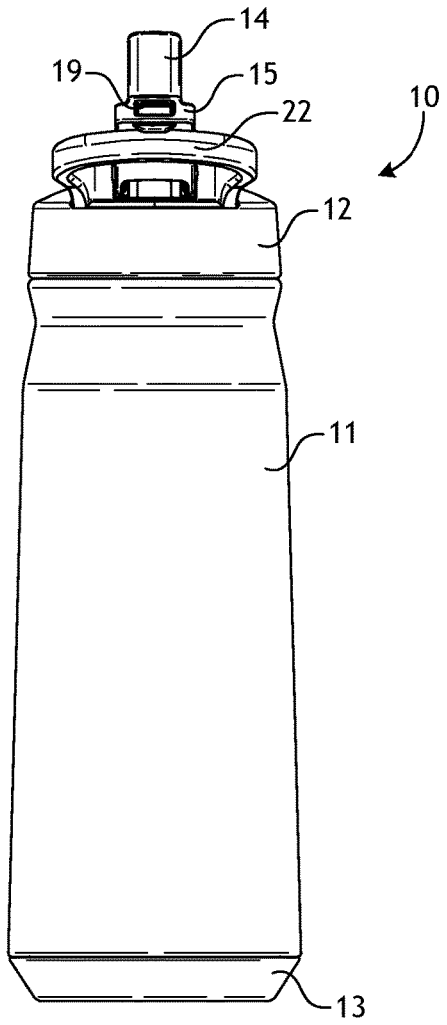
FIG. 6 is a backside view of one embodiment of a drinking vessel with a hygienic straw in its open configuration.
Figure 7:
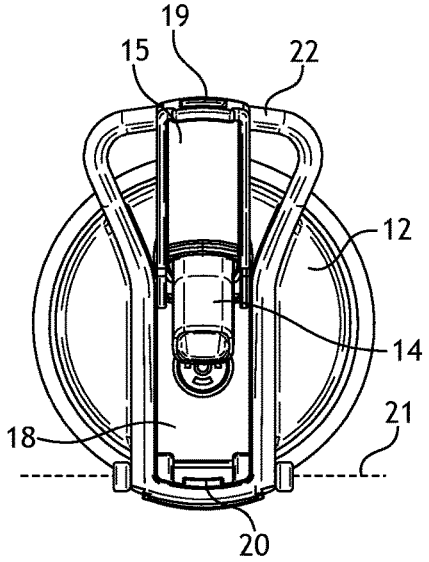
FIG. 7 is a top view of one embodiment of a drinking vessel with a hygienic straw in its open configuration.
Figure 8:
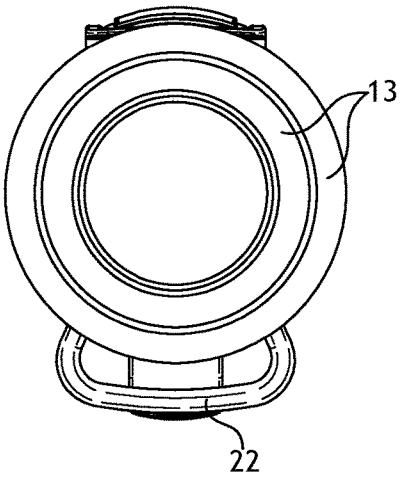
FIG. 8 is a bottom view of one embodiment of a drinking vessel with a hygienic straw.

FIG. 5 is a front side view of one embodiment 10 of a drinking vessel with a hygienic straw in its open configuration. FIG. 6 is a backside view of one embodiment 10 of a drinking vessel with a hygienic straw in its open configuration. FIG. 7 is a top view of one embodiment 10 of a drinking vessel with a hygienic straw in its open configuration. FIG. 8 is a bottom view of one embodiment 10 of a drinking vessel with a hygienic straw Like numbers in each of FIGS. 5-10 correspond to like numbers in FIGS. 1-4.

While FIGS. 5-7 show the same features—albeit in different views—as FIGS. 1-4, FIG. 8 depicts more detail of bumper guard 13. Specifically, in this particular embodiment, bumper guard 13 is shown as existing on the bottom of container 11, as well as around the beveled lower portion thereof. The beveling of the lower portion can also be seen in FIGS. 1-6. Bumper guard 13 can be formed from a material different from that of container 11. It is affixed to or otherwise integrated onto container 11 in order to provide a skid-proof surface, a scratch-proof surface, and/or one that inhibits condensation, thereby protecting the surface on which vessel combination 10 is placed.

Figure 29:
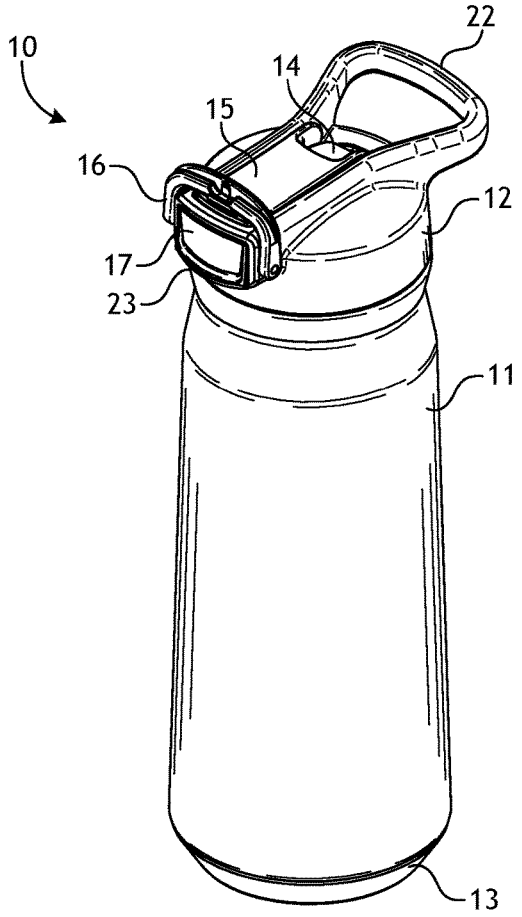
FIG. 29 is a front side perspective view of one embodiment of a drinking vessel with a hygienic straw in its closed, locked configuration.

FIG. 9 is a front side perspective view of one embodiment 10 of a drinking vessel with a hygienic straw in its closed, unlocked configuration. This embodiment is said to be in its "unlocked" configuration because lock 16 is in its unlocked position, namely it is not engaged on the top of lid cover 15. As will be described in more detail in connection with at least FIG. 29, lock 16 is mounted to lid 12 so that it pivots about an axis, which could be the same or different from axis 21. FIG. 9 shows the lock pivoted to its unlocked position, whereas FIG. 29 shows the lock pivoted to its locked position.

FIG. 9 also shows a protruding edge 24 toward one end of straw cover 15. This protruding edge can serve multiple purposes depending on the embodiment and its specific location on straw cover 15. In one embodiment, protruding edge 24 serves as a mechanism for better gripping straw cover 15 when physically moving it to its closed position. In another embodiment, protruding edge 24 serves as a mechanism for receiving the underside portion of lock 16 to thereby "lock" straw cover 15 in its closed position. Specifically, the height of protruding edge 24 above straw cover 15 is sized to be slightly greater than the distance between the bottom surface of lock 16 (when in its locked position) and the top surface of straw cover 15 (when in its closed position) so that the natural elasticity of lock 16 and/or the ability of straw cover to depress slightly more into straw receptacle area 18 (against the countermanding force exhibited by straw 14) enables lock 16 to snuggly maintain or otherwise "lock" straw cover 15 in its closed position with only very moderate user strength or effort. With straw cover 15 in its closed position and lock 16 in its locked position, straw cover 15 will not open, even when latch 17 is activated (to retract tab 20 from tab receptacle 19), irrespective of the elastic strength of straw 14 and/or any spring-loaded hinge about which straw cover 15 rotates.

Figure 10:
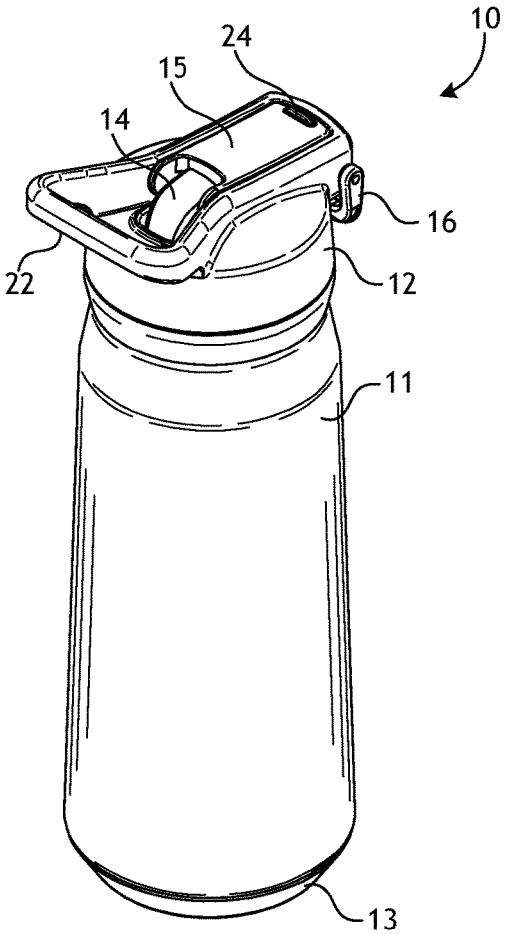
FIG. 10 is a back side perspective view of one embodiment of a drinking vessel with a hygienic straw in its closed, unlocked configuration.

FIG. 10 is a back side perspective view of one embodiment 10 of a drinking vessel with a hygienic straw in its closed, unlocked configuration. Here, one can see how straw 14 is folded/bent so as to be positioned into straw receptacle 18 by closing straw cover 15. It likewise should be evident that the elastic nature of straw 14 exerts some upward (or opening) force on straw cover 15 such that the above-described interaction between tab 20 and tab receptacle 19 are necessary to keep straw cover 15 closed.

Figure 11:
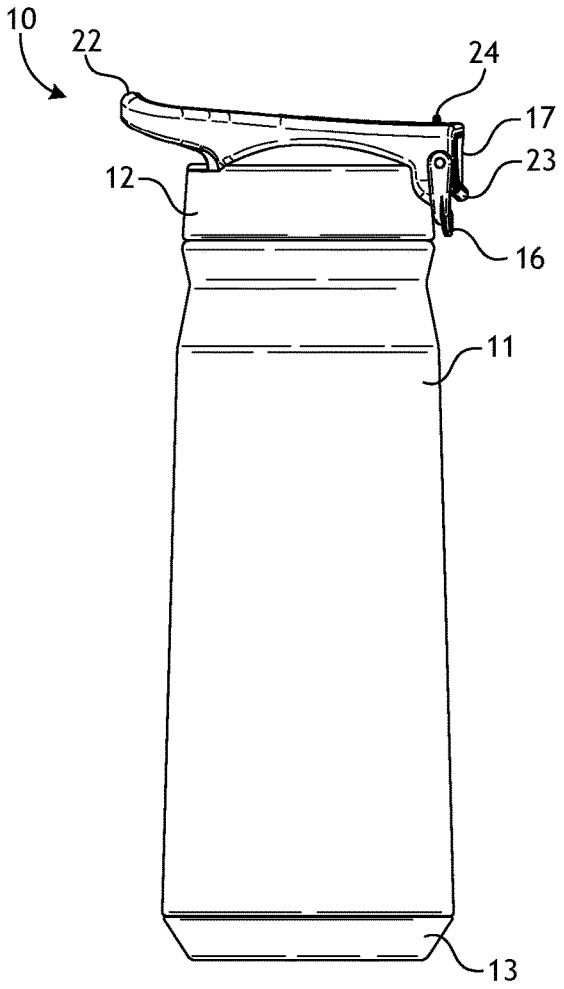
FIG. 11 is a left side view of one embodiment of a drinking vessel with a hygienic straw in its closed, unlocked configuration.
Figure 12:
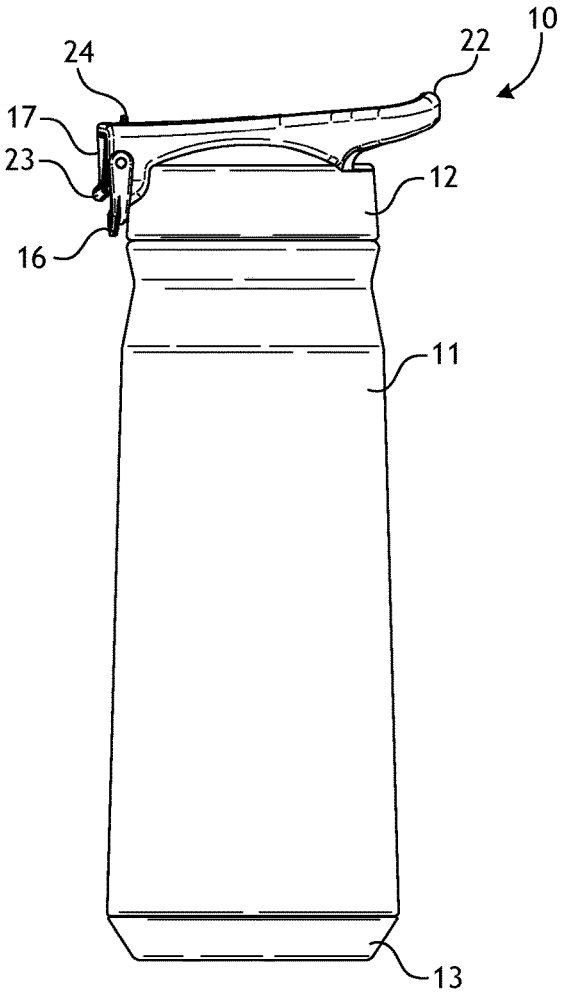
FIG. 12 is a right side view of one embodiment of a drinking vessel with a hygienic straw in its closed, unlocked configuration.
Figure 13:
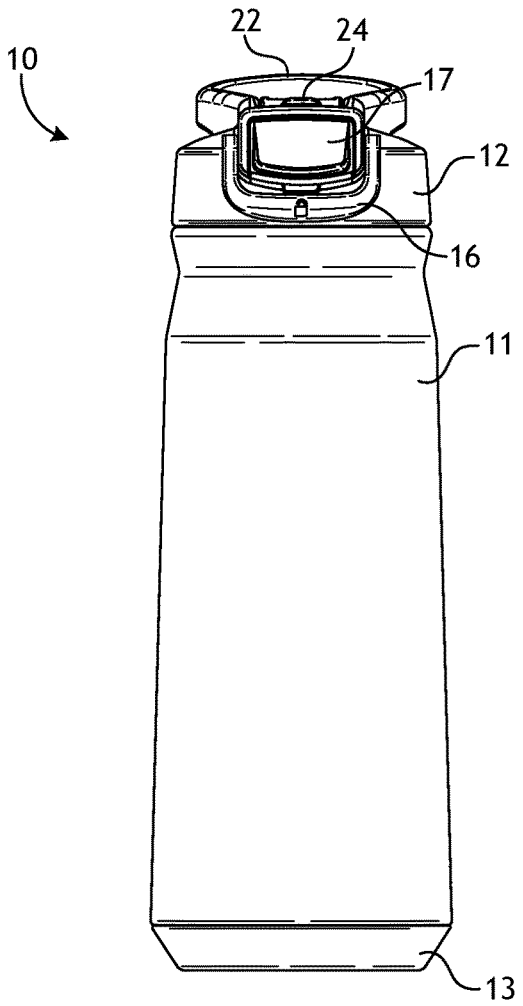
FIG. 13 is a front side view of one embodiment of a drinking vessel with a hygienic straw in its closed, unlocked configuration.
Figure 14:
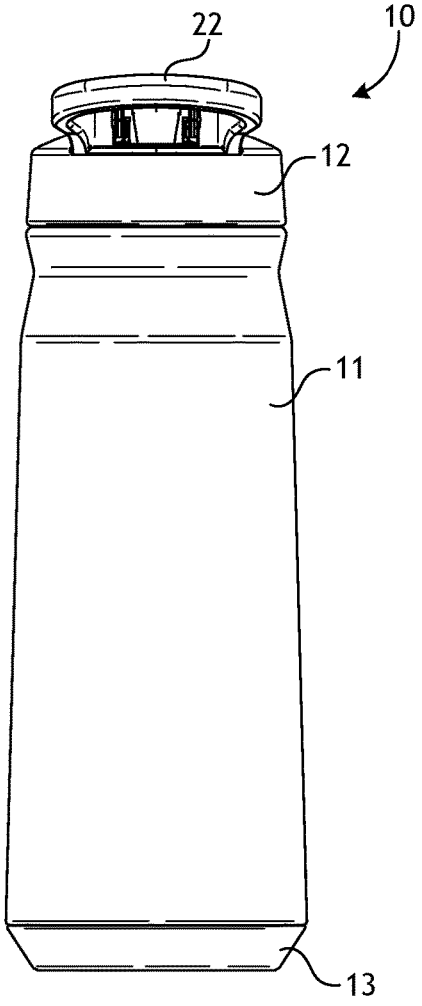
FIG. 14 is a back side view of one embodiment of a drinking vessel with a hygienic straw in its closed configuration.
Figure 15:
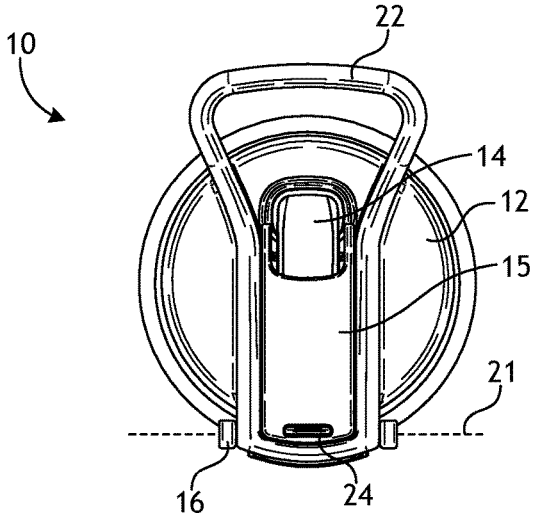
FIG. 15 is a top view of one embodiment of a drinking vessel with a hygienic straw in its closed, unlocked configuration.

FIG. 11 is a left side view of one embodiment 10 of a drinking vessel with a hygienic straw in its closed, unlocked configuration. FIG. 12 is a right side view of one embodiment 10 of a drinking vessel with a hygienic straw in its closed, unlocked configuration. FIG. 13 is a front side view of one embodiment 10 of a drinking vessel with a hygienic straw in its closed, unlocked configuration. FIG. 14 is a back side view of one embodiment 10 of a drinking vessel with a hygienic straw in its closed configuration. FIG. 15 is a top view of one embodiment of a drinking vessel 10 with a hygienic straw in its closed, unlocked configuration. Like numbers in each of FIGS. 11-15 correspond to like numbers in FIGS. 1-10.

Figure 16:
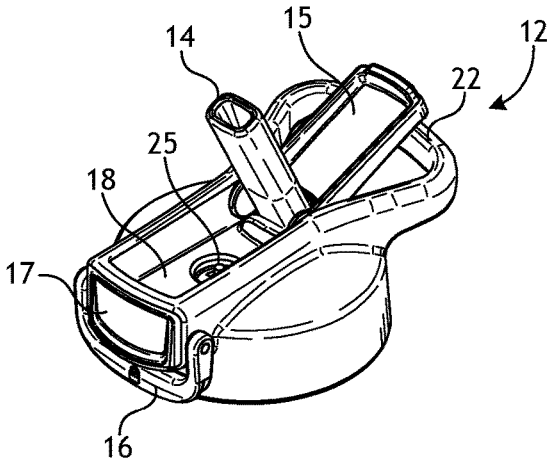
FIG. 16 is a top perspective view of one embodiment of a lid for a drinking vessel with a hygienic straw in its open configuration.

FIG. 16 is a top perspective view of one embodiment of a lid 12 for a drinking vessel with a hygienic straw in its open configuration. In addition to the elements of lid 12 previously described, FIG. 16 depicts valve 25 preferably located in straw receptacle area 18. In a preferred embodiment, valve 25 is an umbrella valve that allows bidirectional airflow. This assists in equalizing the pressure outside and inside the lid/container combination, which makes drinking therefrom (through straw 14) easier.

FIG. 16 also depicts the underside of straw cover 15 has having a concave surface sized in this particular embodiment to house straw 14 when straw cover 15 is in its closed position. Those skilled in the art will appreciate that other configurations of straw cover 15 are possible. FIG. 16 likewise depicts valve 25 being covered by straw 14 and straw cover 15 when straw cover 15 is in its closed position, and being uncovered when straw cover 15 is in it open position. Positioning valve 25 in straw receptacle area 18 in this manner allows ready equalization of pressure (as described) when straw cover 15 is open, and protection from the ambient air conditions when straw cover 15 is in its closed position.

Figure 17:
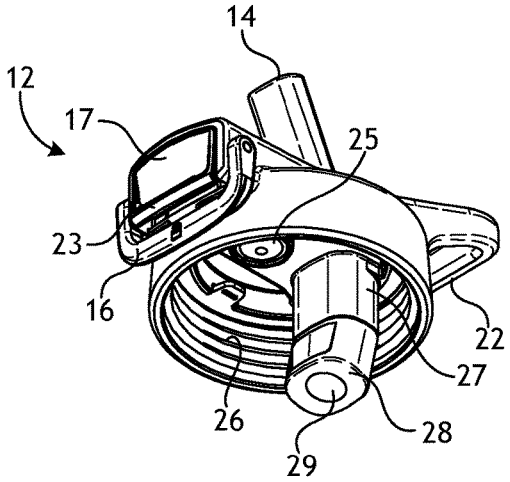
FIG. 17 is a bottom perspective view of one embodiment of a lid for a drinking vessel with a hygienic straw in its open configuration.

FIG. 17 is a bottom perspective view of one embodiment of a lid 12 for a drinking vessel with a hygienic straw in its open configuration. In addition to the elements of lid 12 previously described, FIG. 17 depicts threaded connection 26, which is used to mate with threads on the upper portion of container 11 to form a threaded connection that secures lid 12 to container 11. As indicated above, other attachment mechanisms are contemplated and are within the scope of the present invention.

Figure 35:
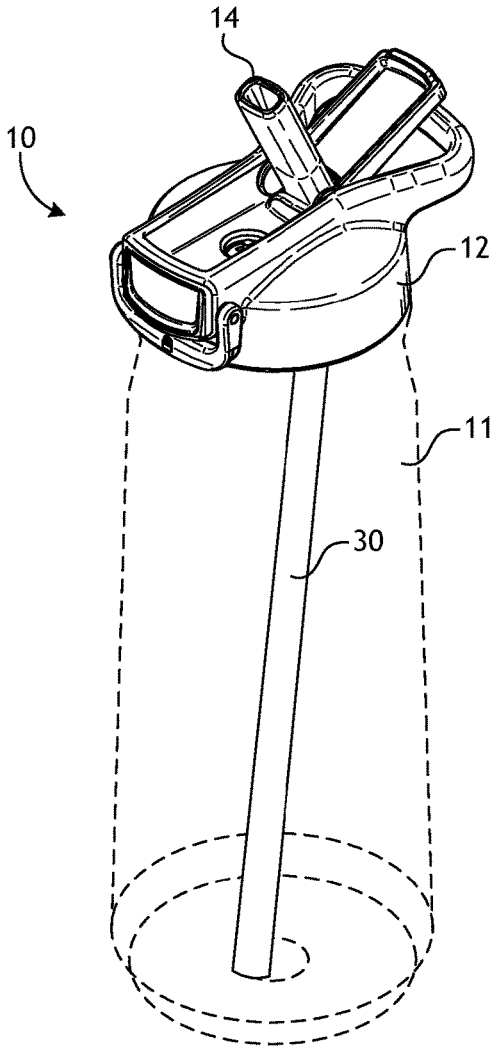
FIG. 35 is a front side perspective view of one embodiment of a drinking vessel with a hygienic straw in its open configuration.
Figure 36:
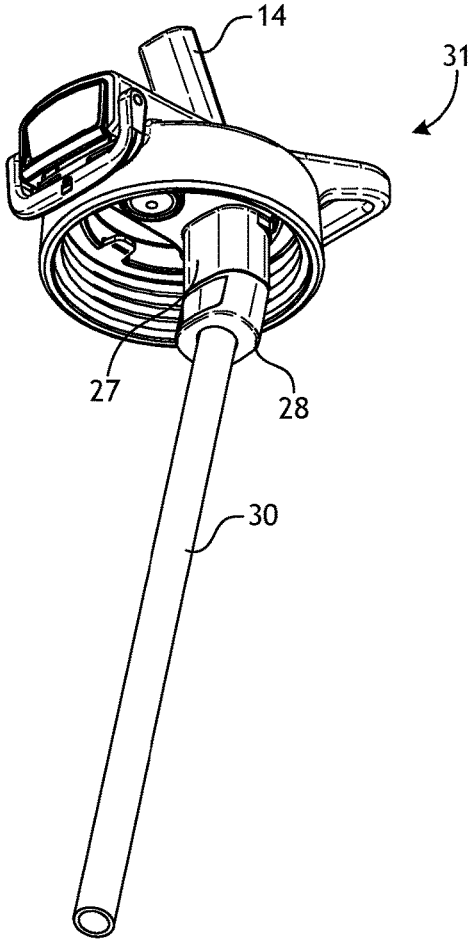
FIG. 36 is a bottom perspective view of one embodiment of a lid for a drinking vessel with a hygienic straw in its open configuration.
Figure 37:
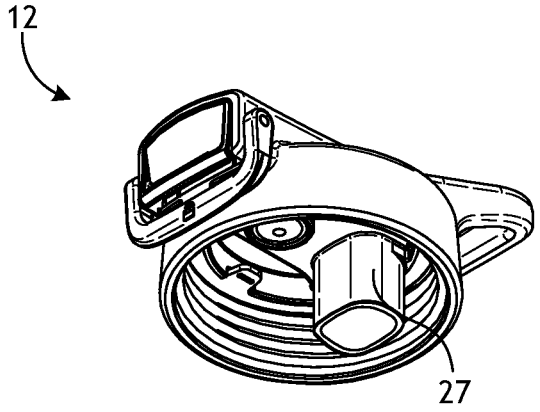
FIG. 37 is a bottom perspective view of one embodiment of a lid for a drinking vessel configured to receive a removable straw.
Figure 38:
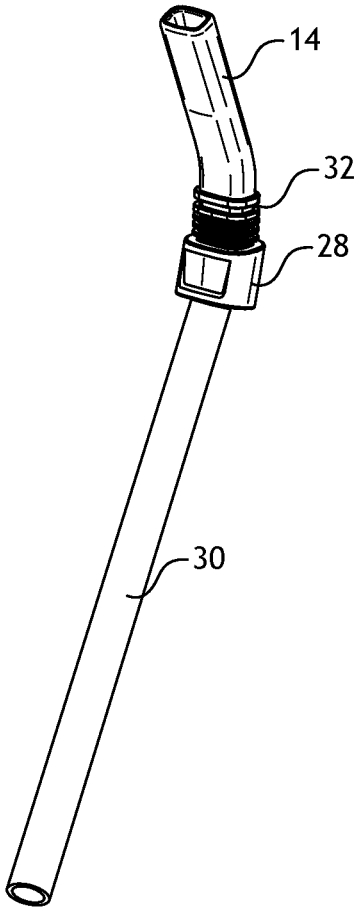
FIG. 38 is a front perspective view of one embodiment of a straw for a drinking vessel.

FIG. 17 also depicts straw insert 27. In this particular embodiment, for which there are others, straw insert 27 is a hollow, molded part of lid 12, through which straw 14 can be removably inserted. In other words, straw insert 27 is sized and configured so that straw 14 (see also FIG. 39) can be inserted into straw insert 27 so as to reside firmly within lid 12, while protruding from the top thereof (as shown in FIGS. 1-7 and 16-17). Straw grip 28 is shown as being part of straw 14, while also being sized and configured to allow a user to use straw grip 28 to insert and remove straw 14 from lid 12. Straw grip 28 further includes straw tube insert 29, which is sized to receive straw tube 30 (see FIG. 40). As described in more detail below, FIG. 38 shows the combination of straw 14 and straw tube 30, where the combination is separate from lid 12. FIG. 36 shows the combination of straw 14 and straw tube 30 mounted in lid 12, whereas FIG. 35 depicts the combination of straw 14 and straw tube 30 being used in combination with container 11.

Figure 18:
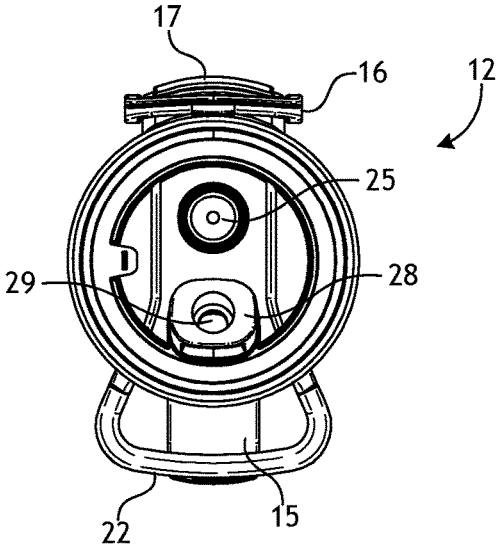
FIG. 18 is a bottom view of one embodiment of a lid for a drinking vessel with a hygienic straw in its open configuration.

FIG. 18 is a bottom view of one embodiment of a lid 12 for a drinking vessel with a hygienic straw in its open configuration. FIG. 18 better depicts valve 25 described above, as well as straw grip 28 and straw tube insert 29. As can be seen, straw tube insert 29—situated in straw grip 28—is sized to receive straw tube 30 (see FIG. 40) and provides a passageway for liquids to be extracted from container 11 via straw 14 and its straw tube 30.

Figure 19:
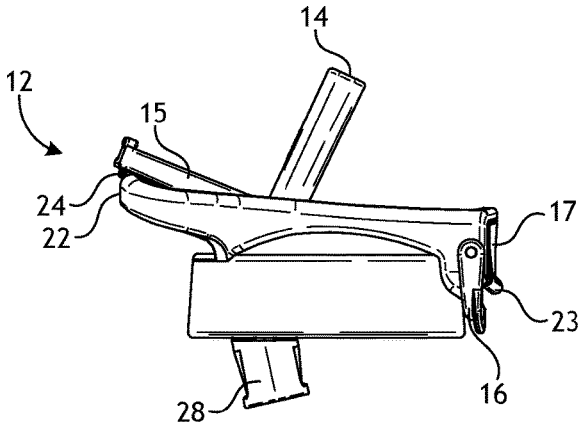
FIG. 19 is a left side view of one embodiment of a lid for a drinking vessel with a hygienic straw in its open configuration.
Figure 20:
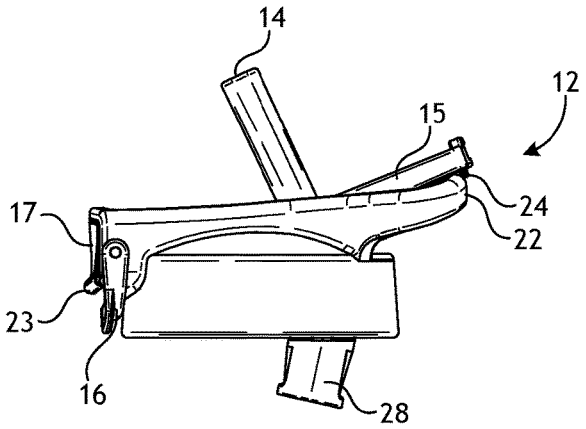
FIG. 20 is a right side view of one embodiment of a lid for a drinking vessel with a hygienic straw in its open configuration.
Figure 21:
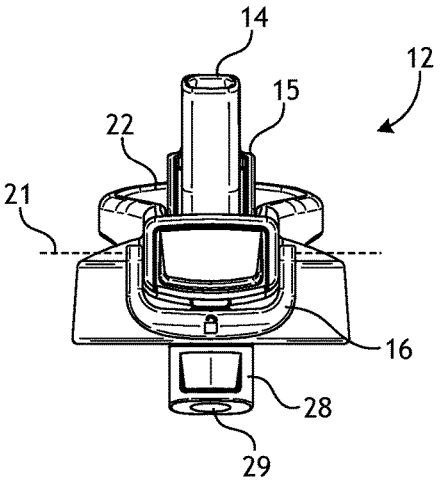
FIG. 21 is a front side view of one embodiment of a lid for a drinking vessel with a hygienic straw in its open configuration.
Figure 22:
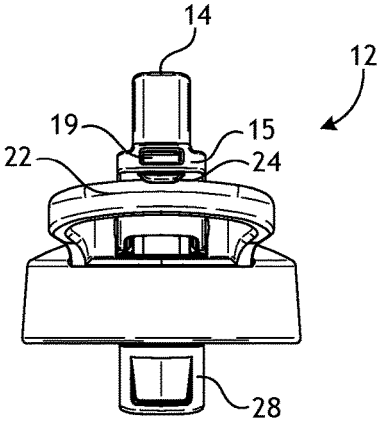
FIG. 22 is a back side view of one embodiment of a lid for a drinking vessel with a hygienic straw in its open configuration.

FIG. 19 is a left side view of one embodiment of a lid 12 for a drinking vessel with a hygienic straw in its open configuration. FIG. 20 is a right side view of one embodiment of a lid 12 for a drinking vessel with a hygienic straw in its open configuration. FIG. 21 is a front side view of one embodiment of a lid 12 for a drinking vessel with a hygienic straw in its open configuration. FIG. 22 is a back side view of one embodiment of a lid 22 for a drinking vessel with a hygienic straw in its open configuration. Like numbers in each of FIGS. 19-22 correspond to like numbers in FIGS. 1-18.

Figure 23:
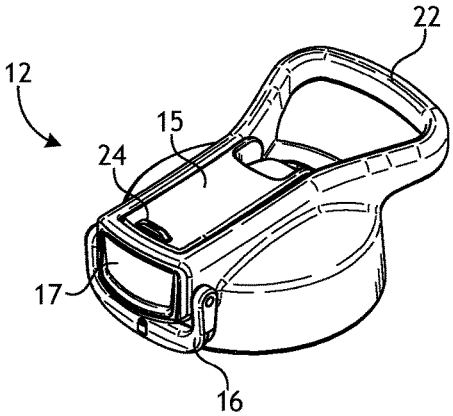
FIG. 23 is a top perspective view of one embodiment of a lid for a drinking vessel with a hygienic straw in its closed, unlocked configuration.
Figure 24:
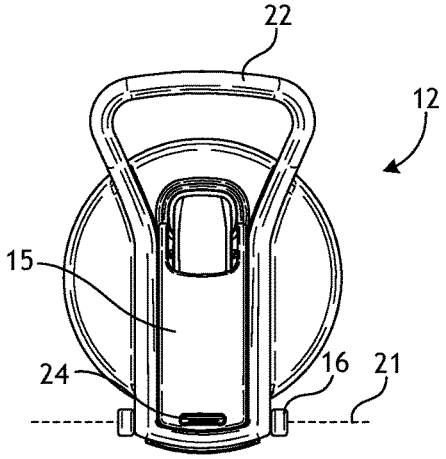
FIG. 24 is a top view of one embodiment of a lid for a drinking vessel with a hygienic straw in its closed, unlocked configuration.
Figure 25:
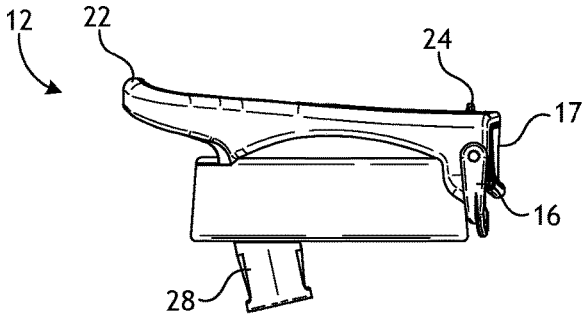
FIG. 25 is a left side view of one embodiment of a lid for a drinking vessel with a hygienic straw in its closed, unlocked configuration.
Figure 26:
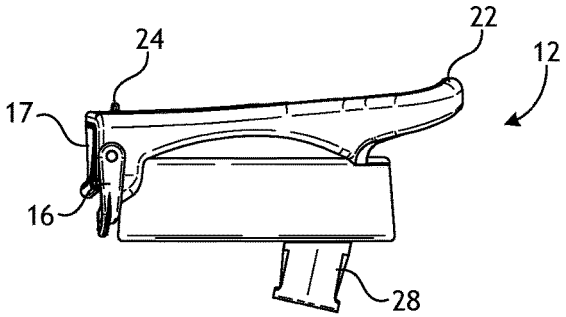
FIG. 26 is a right side view of one embodiment of a lid for a drinking vessel with a hygienic straw in its closed, unlocked configuration.
Figure 27:
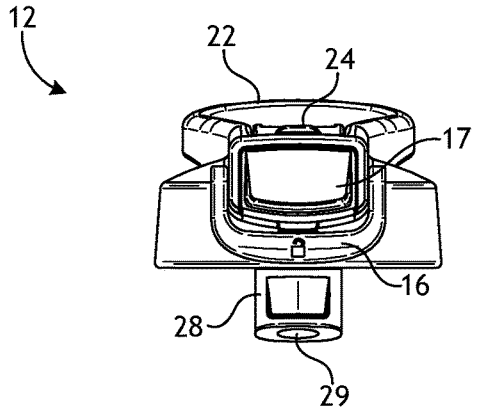
FIG. 27 is a front side view of one embodiment of a lid for a drinking vessel with a hygienic straw in its closed, unlocked configuration.
Figure 28:
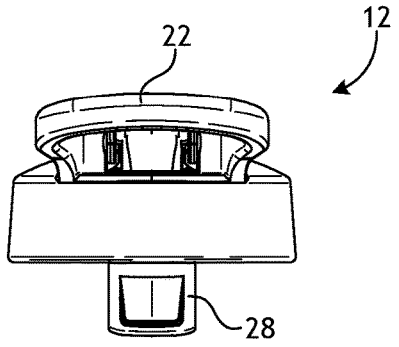
FIG. 28 is a back side view of one embodiment of a lid for a drinking vessel with a hygienic straw in its closed configuration.

FIG. 23 is a top perspective view of one embodiment of a lid 12 for a drinking vessel with a hygienic straw in its closed, unlocked configuration. FIG. 24 is a top view of one embodiment of a lid 12 for a drinking vessel with a hygienic straw in its closed, unlocked configuration. FIG. 25 is a left side view of one embodiment of a lid 12 for a drinking vessel with a hygienic straw in its closed, unlocked configuration. FIG. 26 is a right side view of one embodiment of a lid 12 for a drinking vessel with a hygienic straw in its closed, unlocked configuration. FIG. 27 is a front side view of one embodiment of a lid 12 for a drinking vessel with a hygienic straw in its closed, unlocked configuration. FIG. 28 is a back side view of one embodiment of a lid 12 for a drinking vessel with a hygienic straw in its closed configuration. Like numbers in each of FIGS. 23-28 correspond to like numbers in FIGS. 1-22.

FIG. 29 is a front side perspective view of one embodiment 10 of a drinking vessel with a hygienic straw in its closed, locked configuration. As described above, the embodiment is said to be "locked" when lock 16 is positioned on top of straw cover 15. More specifically, the height of protruding edge 24 above straw cover 15 is sized to be slightly greater than the distance between the bottom, inside surface of lock 16 (when in its locked position) and the top surface of straw cover 15 (when in its closed position) so that the natural elasticity of lock 16 and/or the ability of straw cover 15 to depress slightly more into straw receptacle area 18 (against the countermanding force exhibited by straw 14) enables lock 16 to snuggly maintain or otherwise "lock" straw cover 15 in its closed position with only very moderate user strength or effort. With straw cover 15 in its closed position and lock 16 in its locked position, straw cover 15 will not open when latch 17 is activated (to retract tab 20 from tab receptacle 19), irrespective of the elastic strength of straw 14 or any force imparted by an embodiment were the hinged axis of straw cover 15 is spring loaded.

Figure 30:
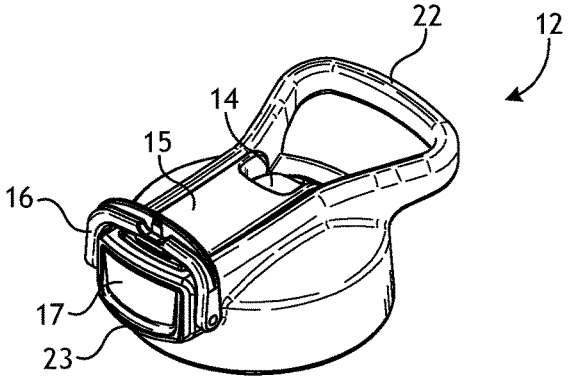
FIG. 30 is a top perspective view of one embodiment of a lid for a drinking vessel with a hygienic straw in its closed, locked configuration.

FIG. 30 is a top perspective view of one embodiment of a lid 12 for a drinking vessel with a hygienic straw in its closed, locked configuration Like numbers in FIG. 30 correspond to like numbers in FIGS. 1-29.

Figure 31:
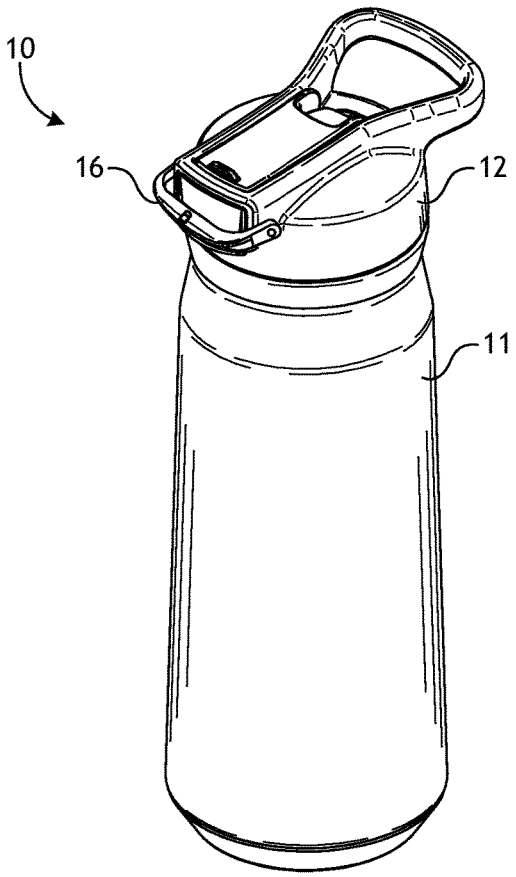
FIG. 31 is a front side perspective view of one embodiment of a drinking vessel with a hygienic straw in its closed, unlocked configuration.
Figure 32:
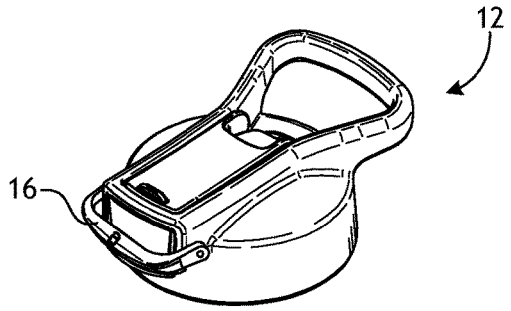
FIG. 32 is a top perspective view of one embodiment of a lid for a drinking vessel with a hygienic straw in its closed, unlocked configuration.
Figure 34:
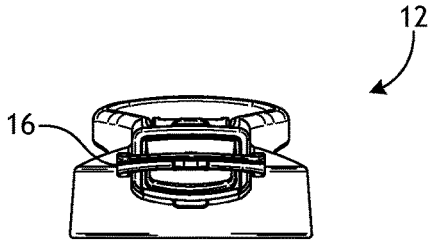
FIG. 34 is a front view of one embodiment of a lid for a drinking vessel with a hygienic straw in its closed, unlocked configuration.

FIG. 31 is a front side perspective view of one embodiment 10 of a drinking vessel with a hygienic straw in its closed, unlocked configuration. FIG. 32 is a top perspective view of one embodiment of a lid 12 for a drinking vessel with a hygienic straw in its closed, unlocked configuration. FIG. 34 is a front view of one embodiment of a lid 12 for a drinking vessel with a hygienic straw in its closed, unlocked configuration. The difference between these Figures and some of the other Figures already mentioned is that these Figures show lock 16 in its mid-way position between the locked and unlocked position. Since these embodiments are not locked, they are described as being unlocked. In other words, the only time the embodiment is locked is when lock 16 is positioned on top of straw cover 15 so as to prevent straw cover 15 from retracting to its open position when a user activates latch 17. FIGS. 31, 32, and 34 likewise further depict the range of motion lock 16 traverses over the hinged axis that attaches lock 16 to lid 12. Lock 16 is shown in its fully locked position in FIG. 29 and its fully unlocked position in FIG. 1.

Figure 33:
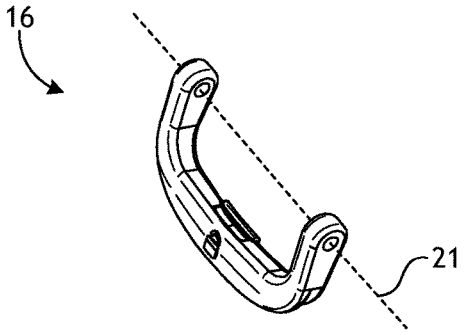
FIG. 33 is a top perspective view of one embodiment of a locking mechanism for a lid for a drinking vessel with a hygienic straw.

FIG. 33 is a top perspective view of one embodiment of lock 16. As also shown in FIG. 33, lock 16 rotates about an axis 21 when mounted to lid 12. Axis 21 can be the same as or different from the axis 21 that latch 17 rotates about when it is mounted to lid 12. Both embodiments are within the scope of the present invention. As indicated, the rotation of lock 16 about its axis is done by hand so that a user can decide whether to lock or unlock straw cover 15.

FIG. 35 is a front side perspective view of one embodiment 10 of a drinking vessel with a hygienic straw in its open configuration. FIG. 35 shows container 11 in an ornamental view so as to depict the manner in which (in one embodiment) straw tube 30 extends from lid 12 into container 11. Straw tube 30 preferably is long enough to substantially reach the bottom of container 11 so as to allow a user to extract substantially all of the liquid contents (via straw 14 and straw tube 30) from container 11.

FIG. 36 is a bottom perspective view of one embodiment 31 of a lid for a drinking vessel with a hygienic straw (including a straw tube) in its open configuration. FIG. 36 more specifically depicts the combination of straw tube 30 and straw grip 28, where straw tube 30 is inserted into straw tube insert 29 of straw grip 28.

As shown in connection with FIGS. 37-40, straw 14 can be removed from lid 12. This facilitates cleaning straw 14 and straw tube 30, thereby providing a more sanitary and safe apparatus than that offered by those in which the straw is permanently affixed to the drinking apparatus. As also shown and described above, straw 14 and straw tube 30 are depicted as being separate components, but it should be appreciated that in another embodiment they could be a single, unitary component.

As also shown (see FIGS. 38-39), straw 14 includes straw retainer 32 located immediately next to straw grip 28. (In other embodiments, straw retainer 32 is not located immediately next to straw grip 28.) Straw retainer 32 is sized slightly smaller than straw insert 27 (see FIG. 37), so that straw retainer 32 fits sufficiently snuggly within straw insert 27 that it can be inserted (and removed) by hand with a modicum of force so that it maintains its connection throughout use of the combination by a user. Inserting and removing straw 14 from lid 12 is aided by straw grip 28, which a user can used to better grasp straw 14 when inserting and removing it from lid 12.

Given the preferred configuration of straw 14—with its straw grip 28 and straw retainer 32 designed to be housed within straw insert 27—it should be apparent that straw 14 can only be removed from lid 12 by removing lid 12 from container 11 and pulling straw 14 from the underside of lid 12. Nevertheless, other embodiments are possible. For example, straw 14 could be removed from lid 12 without removing lid 12 from container 11. In such an embodiment, straw grip 28 could be eliminated or moved above straw retainer 32, thereby allowing straw 14 (including straw tube 30) to be removed through/from the top side of lid 12. In such an embodiment, straw insert 27 could optionally be eliminated, such that the interface between straw retainer 32 and the through-hole in lid 12 would operate to hold straw 14 in lid 12.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. An apparatus, comprising:

a container for retaining liquids;

a lid configured to attach to the container;

the lid including a straw wherein the straw includes an elastomeric portion that enables the straw to assume a first position when no force is placed on the straw and to assume a second position when a force is placed on the straw;

the lid further including a straw cover having a top surface and a bottom surface, wherein the straw cover is rotatably mounted to the lid such that the straw cover rotates between an open position and a closed position, and wherein the straw cover further includes a portion through which the straw passes from its top surface to its bottom surface such that the straw passes outside the straw cover and such that said portion exerts the force on the straw when the cover rotates between is open and closed position thereby causing the straw to move between its first and second position; and the lid and straw cover further configured to enable the straw to move between its first and second position without a user physically contacting the straw.

2. The apparatus of claim 1 wherein a portion of the straw extends above a top surface of the lid.

3. The apparatus of claim 2 wherein the lid further includes a straw receptacle area for housing at least a portion of the straw that extends above the top surface of the lid.

4. The apparatus of claim 3 wherein the straw cover covers at least a portion of the straw receptacle area when the straw cover is in its closed position.

5. The apparatus of claim 4 wherein the straw cover and the portion of the straw that extends above the top surface of the lid are positioned relative to one another such that when that the straw cover is in its open position the straw is in its first position, and when the straw cover is in its closed position the straw is in its second position.

6. The apparatus of claim 5 wherein the straw cover is configured such that when it rotates from its open position to its closed position it contacts at least a portion of the straw that extends above the top surface of the lid and forces the straw to assume its second position.

7. The apparatus of claim 6 wherein the straw cover is configured such that when it rotates from its open position to its closed position it contacts at least a portion of the straw that extends above the top surface of the lid and forces at least a portion of the straw into the straw receptacle area.

8. The apparatus of claim 7 wherein the straw is removable.

9. The apparatus of claim 8 wherein the lid includes a fastener for maintaining the straw cover in its close position.

10. The apparatus of claim 9 wherein the lid includes a lock for maintaining the straw cover in its closed position.

11. The apparatus of claim 10 wherein the fastener includes a tab receptacle in the straw cover that engages with a tab on the lid.

12. The apparatus of claim 11 wherein the tab on the lid is part of a latch that is mounted to the lid via a spring loaded hinge that rotates about a first axis such that the spring loading biases the latch to a closed position.

13. The apparatus of claim 12 wherein the tab on the latch rests inside the tab receptacle in the straw cover when the straw cover is in its closed position, thereby maintaining the straw cover in its closed position.

14. The apparatus of claim 13 configured such that the elastomeric portion of the straw causes the straw to assume its first position and the lid cover to assume its open position when the latch is in an open position, where said open position consists of the tab on the lid being removed from the tab receptacle in the straw cover.

15. The apparatus of claim 14 wherein the lock for maintaining the straw cover in its closed position is mounted to the lid via a hinge that rotates about a second axis.

16. The apparatus of claim 15 wherein the first axis and the second axis are the same axis.

17. The apparatus of claim 16 wherein the latch includes a protruding lip that facilitates rotating the latch about the first axis.

18. The apparatus of claim 17 wherein the lid further includes a handle, where the handle is made from a material different from the remainder of the lid.

19. The apparatus of claim 18 wherein the lid includes valve in the straw receptacle.

20. The apparatus of claim 2 wherein the straw cover substantially covers at least a portion of the straw extending above the lid and a portion of the lid below the straw but not other portions of the lid when the straw cover is in its closed position.

21. The apparatus of claim 1 wherein the straw is at least partially accessible from outside the apparatus when the straw cover is in its closed position.

22. The apparatus of claim 1 wherein the straw cover does not fully cover the straw when the straw cover is in its closed position.

23. The apparatus of claim 1 wherein the portion of the straw cover through which the straw passes from its top surface to its bottom surface is located at an end of the straw cover.

* * * * *